US006016866A

United States Patent [19]

Kaltwasser

[11] Patent Number: 6,016,866

[45] Date of Patent: Jan. 25, 2000

[54] ROD GUIDE WITH WEAR GAUGE

[76] Inventor: Daryl Kaltwasser, 22830 Spatswood La., Katy, Tex. 77449-5404

[21] Appl. No.: 09/085,306

[22] Filed: May 27, 1998

[51] Int. Cl.[7] ..... E21B 17/10

[52] U.S. Cl. ..... 166/241.4; 166/113

[58] Field of Search ..... 166/241.2, 241.1, 166/241.4, 241.6, 250.01, 113

[56] References Cited

U.S. PATENT DOCUMENTS

| | | | |
|---|---|---|---|
| 2,153,787 | 4/1939 | Anderson | 166/241.4 |
| 2,863,704 | 12/1958 | Hillman | 166/241.4 |
| 4,171,560 | 10/1979 | Garrett | 29/455 R |
| 4,356,671 | 11/1982 | Gabrielson et al. | 51/325 |
| 4,995,459 | 2/1991 | Mabry | 166/176 |
| 5,115,863 | 5/1992 | Olinger | 166/241.4 |
| 5,487,426 | 1/1996 | O'Hair | 166/378 |
| 5,492,174 | 2/1996 | O'Hair | 166/241.4 |
| 5,613,556 | 3/1997 | Sable et al. | 166/241.4 |
| 5,806,591 | 9/1998 | Sable et al. | 166/241.4 |

*Primary Examiner*—Hoang Dang
*Attorney, Agent, or Firm*—Gunn & Associates, P.C.

[57] ABSTRACT

A rod guide is molded to a sucker rod and includes a plurality of blades, vanes, or fins projecting from the body. At least one of the blades is formed to define a wear gauge with the blade having a graduated width with increasing radius from axis of the sucker rod.

13 Claims, 4 Drawing Sheets

ROD GUIDE WITH WEAR GAUGE

FIELD OF THE INVENTION

The present invention relates generally to the field of guides for sucker rod strings and, more particularly, to a rod guide with plurality of vanes or fins wherein one or more of the vanes has a thickness that varies as the rod guide wears.

BACKGROUND OF THE INVENTION

Rod guides for centralizing sucker rods within production tubing are well known in the art. As shown in FIG. 1, a pumping unit has attached thereto a sucker rod 10. (FIG. 1 was copied from U.S. Pat. No. 5,180,289 to Wenholz et al. and assigned to Baker Hughes Incorporated). At the bottom end of the sucker rod 10 is a reciprocating pump (not shown). As the pumping unit moves the sucker rod 10 down, the barrel of the reciprocating pump fills with the production fluid to be produced. Conversely, as the pumping unit moves the sucker rod up, a valve in the reciprocating pump shuts and the production fluid in the pump barrel is lifted, displacing production fluid above it and forcing one pump-barrel's worth of production fluid out of the hole.

The sucker rod must extend from the pumping unit all the way down to the reciprocating pump, which may be several thousand feet below the surface. Consequently, the sucker rod is subjected to a variety of stresses: compression, tension, torsion, and bending. Further, the sucker rod can "wobble" or bend within the production tubing. This problem of "wobble" or bending has been solved by the installation of rod guides on the sucker rod to centralize the sucker rod within the production tubing thereby controlling rod and tubing wear.

In carrying out this function, the rod guide, generally made of a polymeric material, is subjected to wear. As the rod guide wears down, couplings connecting the various rod guide segments together may come into contact with the tubing. When viewing a partially worn prior art rod guide a certain amount of guesswork is involved in determining the remaining useful life of the rod guide before the couplings begin to suffer wear themselves. Thus, there remains a need for a rod guide that provides a clear, easily determinable gauge of rod guide vane wear.

A prior art sucker rod guide includes a body that is molded in intimate contact with the sucker rod. The body has simultaneously molded therewith a plurality of "fins" or "blades" that extend radially from the body. As used herein, the term "fin" or "blade" refers to the molded portion of the rod guide that extends from the body to guidingly contact the interior surface of production tubing.

As noted above, rod guides are subject to a variety of stresses. One such stress on rod guides results from a bending moment that has been shown to be one significant source of rod guide failure. One reason for this is that rod guides are primarily made of plastic that is molded directly upon a sucker rod. Rod guides are commonly made from a material that conforms to a standard from the National Association of Corrosion Engineers (NACE), Std. TM-01-87-Hydrocarbon Mixture With 500 psi gas consisting of 87.5% $CO_2$ and 12.5% $H_2S$. This standard dictates a material which is resistant to temperature and chemicals (e.g., $H_2S$, certain salts, etc.) and such a material is inherently brittle. Rod guides are commonly made of ryton, nylon, polyurethane, or the like.

To provide a predictable site for rod guide failure, Positive Action Tool Co. of Dallas action produced a rod guide known as "double-plus." "Double-plus" provided two pairs of fins, offset circumferentially from one another by 90°. However, such an arrangement apparently does nothing to reduce the likelihood of such a failure, it simply predetermines where such a failure will occur. Also, such a design presents the same resistance to fluid flow and, in fact, appears to make undesirable turbulent flow more likely.

Thus, there remains a need for a rod guide that is more robust to bending moment without sacrificing any of the other important features previously noted.

SUMMARY OF THE INVENTION

The present invention addresses these and other shortcomings of the prior art. The present invention comprises a rod guide with a plurality of blades or fins and at least one of the fins is defined by a graduated thickness or width, with thickness or width increasing with the radius from the centerline of the rod guide. This variation of the thickness of at least one of the vanes of the rod guide serves as an easily readable indication of the remaining useful life of the rod guide.

The vane or vanes preferably include more than one increase in width. The radii from the centerline of the rod guide at which these increases in width occur are preferably at the standard radii of commercially available couplings, which are used to join segments of sucker rod together. This provides an easily and readily discernible indication of remaining useful life of the rod guide before wear begins on the coupling.

These and other features of the present invention will be readily apparent to those of skill in the art when they study the following detailed description in conjunction with the accompanying drawings.

DETAILED DESCRIPTION OF A PREFERRED EMBODIMENT

Figure 1:
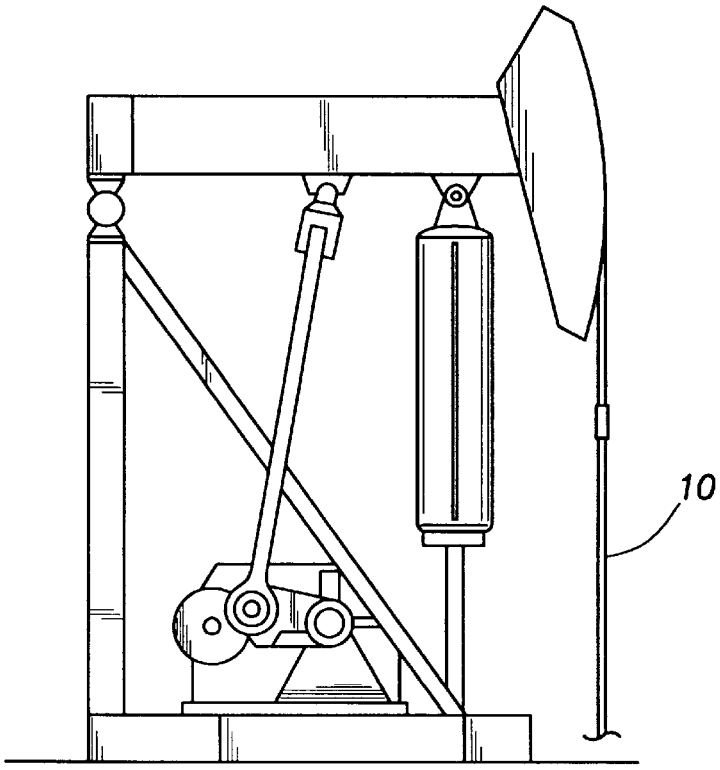
FIG. 1 (PRIOR ART)
FIG. 1 depicts a prior art pumping rig with a sucker rod.
Figure 3:
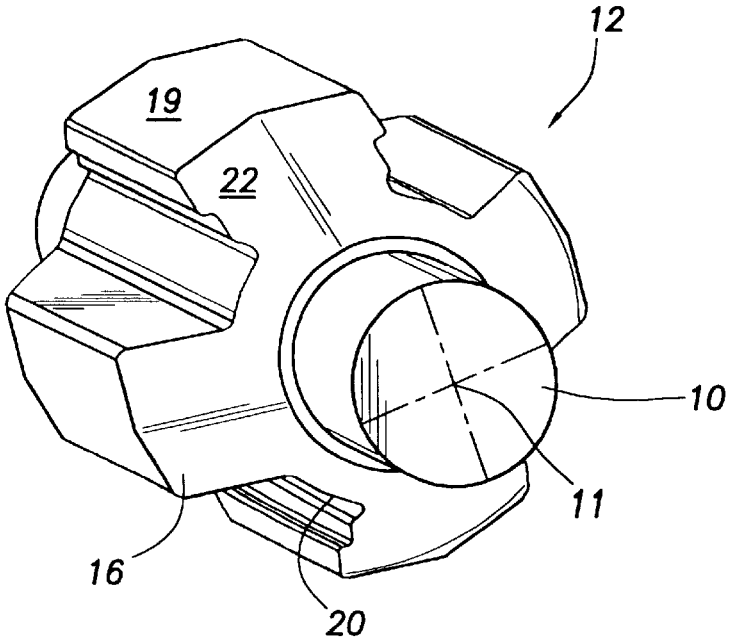
FIG. 3 is another perspective view of the rod guide of this invention, to more clearly depict the graduated width of the vane(s) of the rod guide.
Figure 2:
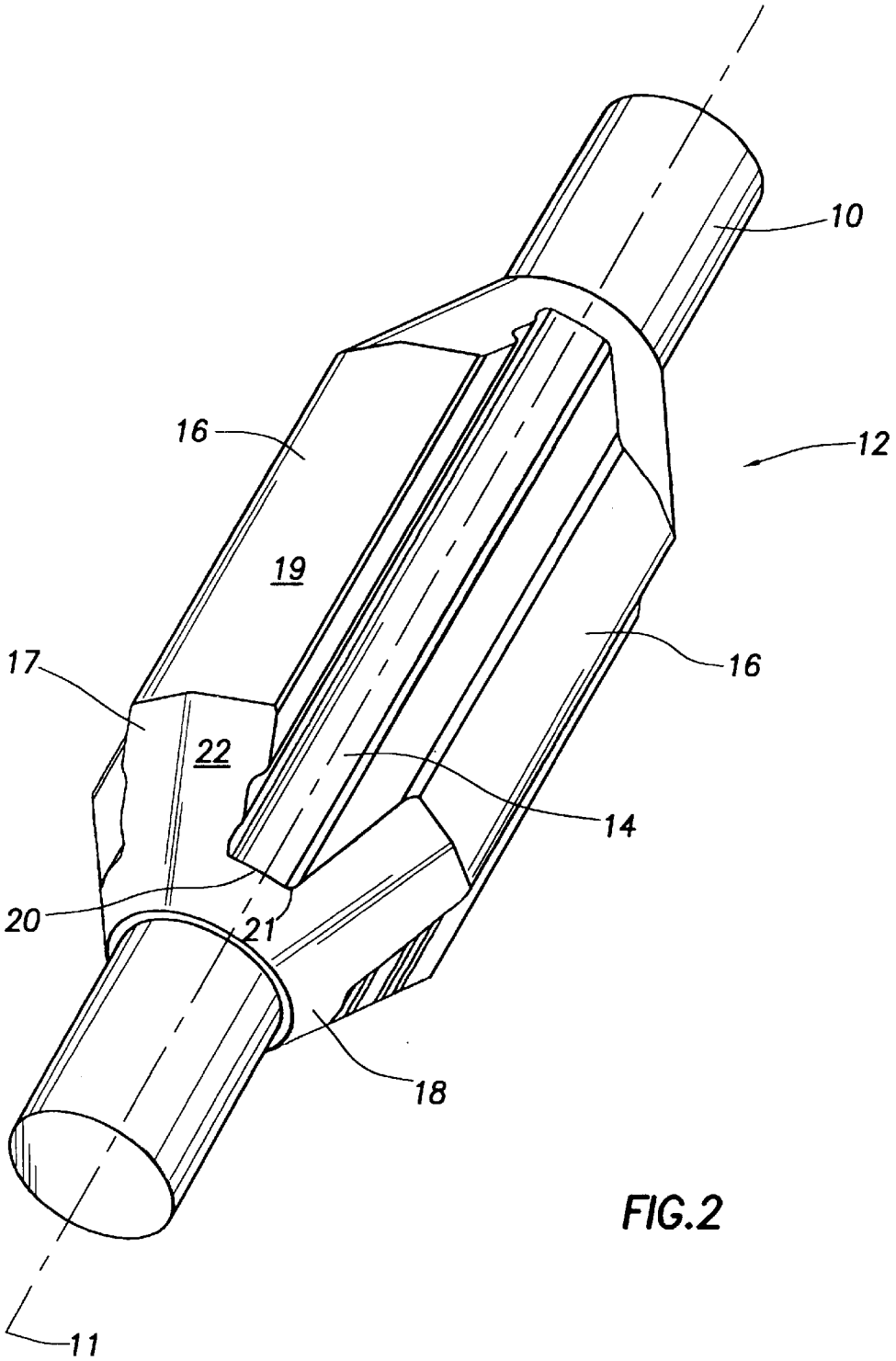
FIG. 2 is a perspective view of a rod guide of the present invention.

FIGS. 2 and 3 depict a rod guide 12 of the present invention. The rod guide 12 is molded directly on the sucker rod 10 (see FIG. 1) about an axis 11. Those of skill in the art will appreciate that a number of rod guides are spaced along the length of the sucker rod, and that sucker rod come in several standard diameters. The rod guide 12 comprises a body 14, a pair of blades, vanes, or fins 16 having substantially vertical sides and a pair of blades 17 having "stair-step" sides. As used herein, the term "stair-step" refers to the structure of the blades 17 in which the width of a blades 17 varies incrementally with the radius from the axis 11, with the width of the blades increasing with distance from the axis. The rod guide also includes a pair of frustoconical cylindrical end caps 18, and the body 14, the blades 16 and 17, and the end caps 18 are all molded as a unitary structure.

Figure 4:
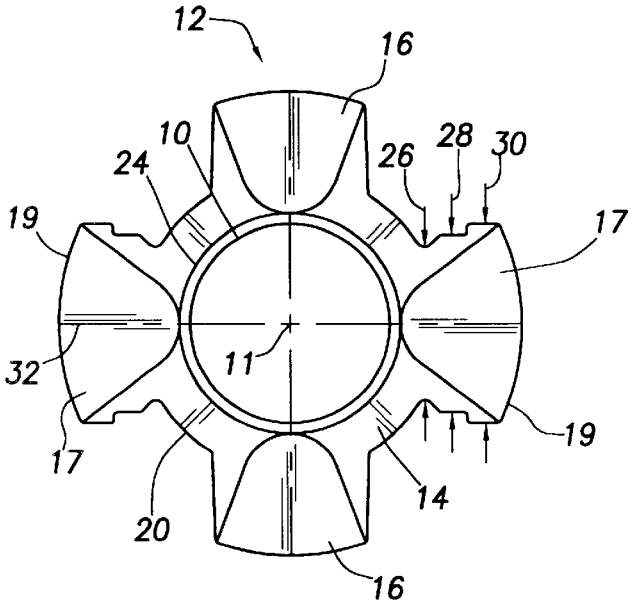
FIG. 4 depicts an end view of a rod guide of the present invention.

The body 14 is substantially a solid cylinder (molded onto the sucker rod) such that the area between each blade defines a convex surface 20, shown more clearly in FIG. 4. Each blade 16 meets the body 14 at an interior corner 21, which comprises a fillet to minimize the failure mode at this location of the rod guide.

Each blade 16 preferably presents a rounded aspect at a blade face 22, since the face 22 is a portion of a frustum of a cone. This curved or rounded aspect helps to reduce hydraulic resistance to the movement of the sucker rod string as it moves in the downward direction. This also reduces turbulent fluid flow behind each blade as the sucker rod string moves down.

The rod guide 12 also defines a wear surface 19 at the extreme of each blade 16. This wear surface 19 contacts the pipe in which the sucker rod is positioned. The length of the vanes times the cross sectional area of the vanes (down to a coupling radius) is known in the art as the "erodable volume." As the rod guide rubs against the pipe, the wear surfaces erode and, unless the rod guide is replaced, may expose couplings between rod segments to friction wear by the pipe. In known rod guides, even when the sucker rod is removed from the pipe and the rod guides are examined, it is difficult to determine the remaining useful life of the rod guide.

Table 1 provides the industry standard coupling sizes, provided by the American Petroleum Institute.

TABLE 1

FULL-SIZE AND SLIM HOLE COUPLINGS
(Dimensions in inches and equivalent in mm.)

| Nominal Coupling Size | Outside Diameter (Full-size) | Outside Diameter (Slim hole) |
|---|---|---|
| ½ (12.7) | N/A | 1 (25.4) |
| ⅝ (15.9) | 1 ½ (38.1) | 1 ¼ (31.8) |
| ¾ (19.1) | 1 ⅝ (41.3) | 1 ½ (38.1) |
| ⅞ (22.2) | 1 13/16 (46.0) | 1 ⅝ (41.3) |
| 1 (25.4) | 2 3/16 (55.6) | 2 (50.8) |
| 1 ⅛ (25.6) | 2 ⅜ (60.3) | N/A |

Figure 5:
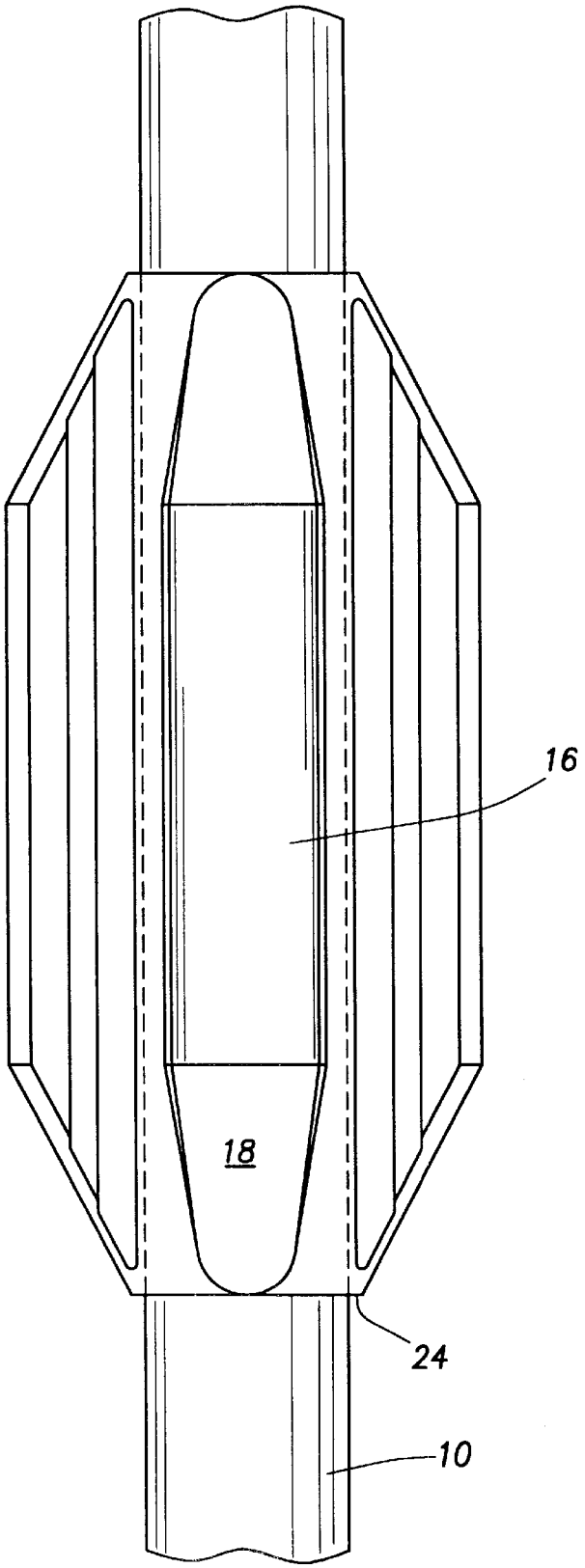
FIG. 5 depicts a side view of the rod guide of this invention.

FIGS. 4 and 5 depict end and side views of the rod guide 12 of this invention. The rod guide 12 is molded onto a sucker rod 10 as a unitary structure. The rod guide may present a small front face 24 as a result of the molding process, and the height of the front face 24 is minimized to reduce the drag of the rod guide. The rod guide includes a pair of blades or fins 16 with substantially vertical sides and a pair of blades or fins 17 with stair-step sides. Closest to the body 14 the blades 17 define a first width 26, and, with increasing distance from the axis 11 define a second width 28 and a third width 30. The width 28 is greater than the width 26 and the width 30 is greater than the width 28. This structure is the preferred embodiment but a single increase in width may be used and fall within the scope of this invention. From another perspective, the blades 17 define a graduated width that increases with radial distance from the axis.

FIG. 4 also depicts a line 32 which defines a parting line. This line 32 illustrates where the two halves of the mold will be separated and this structure is called for so that the two halves of the mold can be easily separated. Thus, the rod guide is molded of mirror images on either side of the parting line, which runs through the blades of graduated width.

Figure 6:
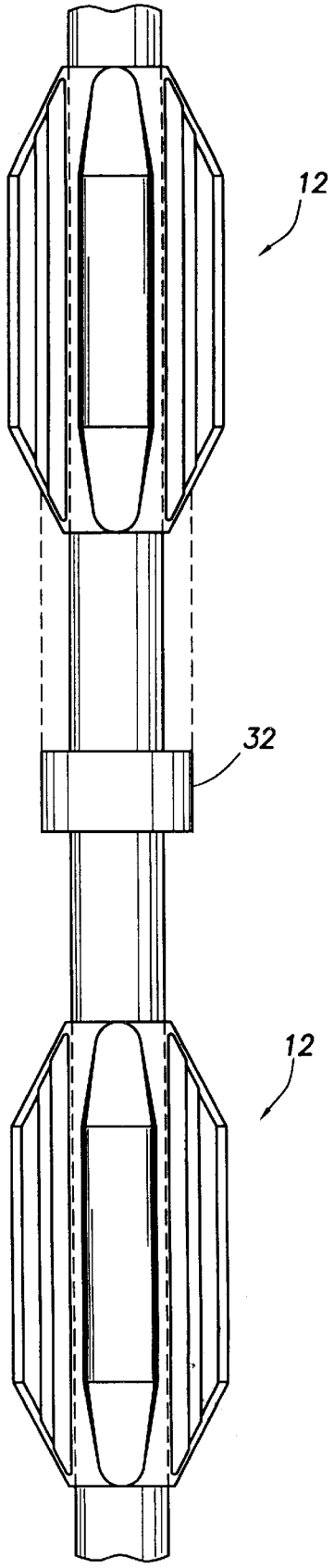
FIG. 6 is a side view of a pair of rod guides of this invention on sections of sucker rod which are joined with an industry standard coupling.

FIG. 6 depicts the use of rod guides incorporating the present invention joined together with a conventional, industry standard coupling 32. The construction of such a coupling is well known in the art and dimensional details are shown in Table 1, above. In use, as the vane 17 wears away, it eventually erodes to a level at which it must be replaced. Those of skill in the art will appreciate that, due to the geometry of the vanes, that level must actually be higher than the coupling by some margin to provide protection to the coupling.

The present invention also presents a method of forming a rod guide on a sucker rod. The body of the rod guide with unitary fins or blades is molded directly upon a sucker rod. Since the width of the fins with the wear gauge feature is greater at a radius further from the axis 11, the mold pieces must be placed on top and bottom of the rod guide, as seen from the perspective of FIG. 4. Placing the mold halves to the left and right of FIG. 4 results in some difficulty in separating the mold halves after the rod guide material has cured.

The principles, preferred embodiment and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A rod guide comprising:

a. a body molded to a sucker rod along an axis; and b. a plurality of blades projecting from the body, at least one of the blades defining a graduated width that increases in steps with radial distance from the axis.

2. The rod guide of claim 1 wherein at least one of the plurality of blades defines substantially vertical opposing sides.

3. The rod guide of claim 2 wherein each of the blades defines a wear surface with a substantially circular radius of curvature.

4. The rod guide of claim 3 wherein the blades define a front face having a frustoconical surface.

5. The rod guide of claim 1 wherein the rod guide is molded of mirror image halves on either side of a parting line defined by a mold from which the rod guide is made, and wherein the parting line runs through said at least one of the blades defining a graduated width.

6. A rod guide comprising:

a. a body molded to a sucker rod along an axis;

b. a first pair of blades projecting from the body and molded as an integral unit with the body, each of the first pair of blades defining a graduated width that increases with radial distance from the axis; and c. a second pair of blades projecting from the body and molded as an integral unit with the body, each of the second pair of blades defining a substantially uniform width with radial distance from the axis.

7. The rod guide of claim 6, wherein each of the first pair of blades defines a first width between the body and a first radius from the axis and a second width between the first radius from the axis and a second radius from the axis, and wherein the second width is greater than the first width.

8. The rod guide of claim 7 wherein the first radius is greater than the radius of a standard sucker rod coupling.

9. The rod guide of claim 6 wherein each of the blades defines a wear surface with a substantially circular radius of curvature.

10. The rod guide of claim 6 wherein the blades define a front face having a frustoconical surface.

11. A sucker rod structure comprising:

a. a first sucker rod segment coupled to a second sucker rod segment by a standard coupling;

b. a rod guide on each of the first and second sucker rod segments, the rod guide comprising:

i. a body molded to a sucker rod along an axis; and ii. a plurality of blades projecting from the body, at least one of the blades defining a graduated width that increases in steps with radial distance from the axis.

12. The rod guide of claim 11, wherein the at least one of the blades defines a first width between the body and a first radius from the axis and a second width between the first radius from the axis and a second radius from the axis, and wherein the second width is greater than the first width.

13. The rod guide of claim 12 wherein the first radius is greater than the radius of the coupling.

* * * * *